US008777128B2

(12) United States Patent
Strock et al.

(10) Patent No.: US 8,777,128 B2
(45) Date of Patent: Jul. 15, 2014

(54) DEVICE FOR SPRAY APPLICATIONS INCLUDING AT LEAST ONE CLEANING PORT

(75) Inventors: Christopher W. Strock, Kennebunk, ME (US); Robert D. Richard, Springvale, ME (US)

(73) Assignee: United Technologies Corporation, Hartford, CT (US)

( * ) Notice: Subject to any disclaimer, the term of this patent is extended or adjusted under 35 U.S.C. 154(b) by 1 day.

(21) Appl. No.: 13/212,431

(22) Filed: Aug. 18, 2011

(65) Prior Publication Data

US 2013/0043325 A1 Feb. 21, 2013

(51) Int. Cl.

| | |
|---|---|
| ***B05B 7/00*** | (2006.01) |
| ***B05B 15/02*** | (2006.01) |
| *B05B 7/06* | (2006.01) |

(52) U.S. Cl.

CPC ..... *B05B 15/025* (2013.01); *B05B 15/0258* (2013.01); *B05B 7/061* (2013.01)

USPC ..... 239/428; 239/112; 239/425; 239/433; 239/434

(58) Field of Classification Search

CPC .. B05B 15/025; B05B 15/02; B05B 15/0258; B05B 15/0208; B05B 7/061

USPC ..... 239/112, 116, 119, 426, 428, 433, 434, 239/425

See application file for complete search history.

(56) References Cited

U.S. PATENT DOCUMENTS

| | | | | |
|---|---|---|---|---|
| 2,695,813 | A * | 11/1954 | Rosanowski | 239/428 |
| 3,929,291 | A | 12/1975 | Ladisch | |
| 3,929,921 | A | 12/1975 | Wilke et al. | |
| 4,605,168 | A | 8/1986 | Tachi et al. | |
| 4,924,059 | A | 5/1990 | Rotolico et al. | |
| 5,351,886 | A * | 10/1994 | Bull et al. | 239/119 |
| 5,941,456 | A * | 8/1999 | Waryu et al. | 239/112 |
| 7,172,138 | B2 * | 2/2007 | Mather et al. | 239/106 |
| 7,557,324 | B2 | 7/2009 | Nylen et al. | |
| 7,644,872 | B2 | 1/2010 | Lang et al. | |
| 2007/0221751 | A1 * | 9/2007 | Lang et al. | 239/290 |
| 2008/0060574 | A1 | 3/2008 | Bacchus et al. | |
| 2008/0251503 | A1 | 10/2008 | Noujaim | |
| 2010/0314467 | A1 | 12/2010 | Wigren et al. | |

FOREIGN PATENT DOCUMENTS

WO 2006138448 A2 12/2006

OTHER PUBLICATIONS

Extended European Search Report for Application No. EP 12 18 0388 dated Jan. 9, 2013.

* cited by examiner

*Primary Examiner* — Jason Boeckmann
(74) *Attorney, Agent, or Firm* — Carlson, Gaskey & Olds

(57) ABSTRACT

An exemplary device for spray applications includes a nozzle configured to emit a first fluid stream in a downstream direction away from the nozzle. At least one feed port situated near the nozzle introduces an agent into the first fluid stream to be carried by the first fluid stream in the downstream direction. At least one cleaning port situated near the nozzle emits a second fluid stream in a generally upstream direction toward at least one of the nozzle or the feed port.

14 Claims, 2 Drawing Sheets

DEVICE FOR SPRAY APPLICATIONS INCLUDING AT LEAST ONE CLEANING PORT

BACKGROUND

Spray applications are used for a variety of coating processes. Some spray application devices include a primary fluid stream into which a coating agent is introduced. The primary fluid stream including the coating agent is directed at a work piece to achieve the desired coating. It is necessary to maintain control over the fluid flow and the introduced coating agent to achieve a desired coating.

One challenge presented in many spray application devices is that build up may occur on the application device components. For example, in thermal spray applications, the coating agent comprises fine particles that can tend to build up on the spray nozzle, powder ports and other spray components. Such build up interferes with proper powder introduction to the primary fluid stream such as a plasma plume. Without proper powder injection, a variation in the coating properties may occur resulting in an imperfect coating on the work piece.

SUMMARY

An exemplary device for spray applications includes a nozzle configured to emit a first fluid stream in a downstream direction away from the nozzle. At least one feed port situated near the nozzle introduces an agent into the first fluid stream to be carried by the first fluid stream in the downstream direction. At least one cleaning port situated near the nozzle emits a second fluid stream in a generally upstream direction toward at least one of the nozzle or the feed port.

An exemplary method of cleaning a spray application device having a nozzle that is configured to emit a first fluid stream in a downstream direction away from the nozzle and at least one feed port that is situated to introduce an agent into the first fluid stream includes directing a second fluid stream from at least one cleaning port in a generally upstream direction toward at least one of the nozzle or the feed port.

The various features and advantages of a disclosed example embodiment will become apparent to those skilled in the art from the following detailed description. The drawings that accompany the detailed description can be briefly described as follows.

DETAILED DESCRIPTION

Figure 1:
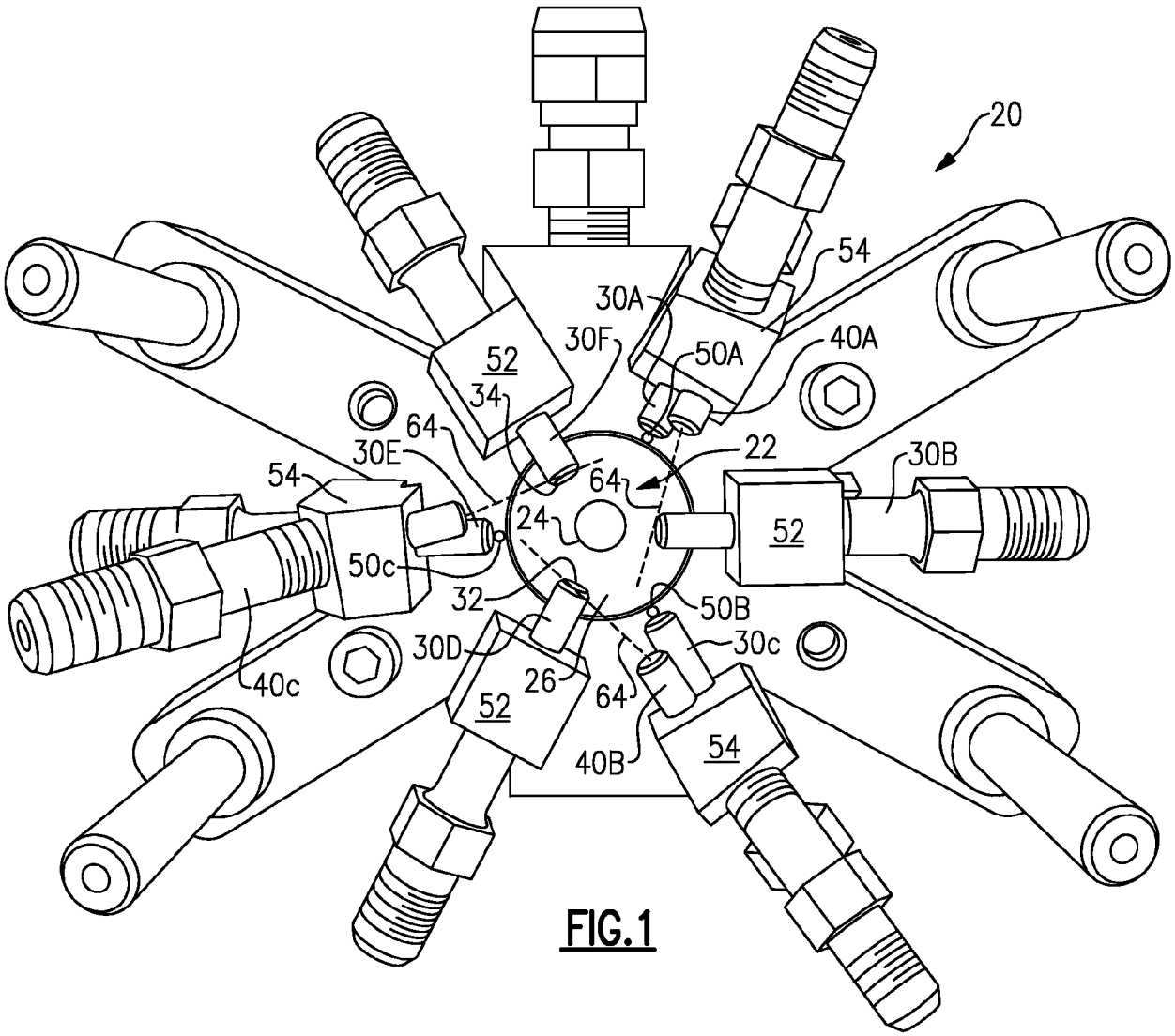
FIG. 1 diagrammatically illustrates a spray application device designed according to an example embodiment of this invention.

FIG. 1 illustrates a spray application device 20 that includes a nozzle 22 configured to emit a first fluid stream through an opening 24. The first fluid stream moves in a downstream direction away from the nozzle 22 (e.g., out of the page in the illustration). The example nozzle 22 includes a nozzle face 26 that generally surrounds the opening 24. In this example, the nozzle face 26 is generally planar and comprises a metal material such as copper.

A plurality of feed ports 30 are situated near the nozzle 22. The illustrated feed ports 30A-30F introduce an agent into the first fluid stream that is emitted from the nozzle 22. In one example, the feed ports 30 introduce a coating agent such as powder into the first fluid stream. In one example, the spray application device is useful for thermospray processes and the first fluid stream comprises a plasma plume. The agent introduced by the feed ports 30A-30F comprises powder particles of a composite of a nickel alloy and hexagonal boron nitride in one example.

Each of the feed ports 30 includes an opening 32 through which the selected coating agent is emitted for being introduced into the first fluid stream. The openings 32 in the illustrated example extend through ends 34 of the feed ports 30. Each end 34 is positioned relatively close to the opening 24 of the nozzle 22. As can be appreciated from the illustration, some of the ends 34 are spaced radially inward and closer to the opening 24 compared to others of the ends 34. The example feed ports 30A-30F are circumferentially, equally spaced about the opening 24 in the illustrated example.

During use it is possible for the agent introduced by the feed ports 30A-30F to build up on the feed ports, the nozzle 22 and other portions of the spray application device 20. The illustrated example includes a plurality of cleaning ports 40 situated near the nozzle 22 for emitting a second fluid stream in a generally upstream direction toward at least one of the nozzle 22 or a feed port 30.

In one example, the second fluid stream comprises air. In one example, the second fluid stream has a pressure in a range from 10 psi to 80 psi (703 gram-force/square centimeter to 5625 gram-force/square centimeter).

In the illustrated example, the second fluid stream from each cleaning port 40 is directed at the end 34 of at least one of the feed ports 30 and at the face 26 of the nozzle 22. In one example, at least one of the cleaning ports 40 directs a second fluid stream at the nozzle 22 without directing that second fluid stream toward one of the feed ports 30. In another example, at least one of the cleaning ports 40 directs a second fluid stream toward at least one of the feed ports 30 without directing that second fluid stream at the face 26 of the nozzle 22. In another example, at least one of the cleaning ports 40 directs a second fluid stream toward the tip of at least one of the powder feed ports 30 in such a manner as to not fully interrupt the second fluid stream of which a portion continues toward the nozzle face 26.

In the illustrated example, the cleaning port 40A directs a second fluid stream toward the end 34 of the feed port 30B. The cleaning port 40B directs a second fluid stream toward the end 34 of the feed port 30D. The cleaning port 40C directs a fluid steam toward the end 34 of the feed port 30F. As can be appreciated from the illustration, the direction of the second fluid stream is generally perpendicular to a direction that the selected coating agent is emitted from the feed ports. The second fluid stream in the illustrated example preferably glances across the end 34 of a selected feed port and is not directed into the opening 32 of that feed port.

The second fluid stream from each of the cleaning ports 40A-40C in the illustrated example is also at least partially incident on the face 26 of the nozzle 22. The second fluid streams clean off built up particles from the feed ports 30 and from the nozzle face 26.

As can be appreciated from the illustration, the example of FIG. 1 includes twice as many feed ports 30 as cleaning ports 40. Each of the cleaning ports 40 is dedicated to cleaning one of the feed ports 30 in the illustrated example. The other feed ports (i.e., 30A, 30C and 30E) are cleaned by third fluid streams emitted from cleaning orifices 50 adjacent the nozzle 22. In the illustrated example, the cleaning orifice 50A emits a third fluid stream in a downstream direction for cleaning the end 34 of the feed port 30A. The cleaning orifice 50B emits a third fluid steam in a downstream direction for cleaning the end 34 of the feed port 30C. A cleaning orifice 50C emits a third fluid stream in a downstream direction for cleaning the end 34 of the feed port 30E. In the illustrated example, the combination of the cleaning ports 40 and the orifices 50 provides a cleaning function for cleaning off at least the end of each of the feed ports 30. In this example, each feed port 30 has at least one dedicated fluid stream for cleaning off the end 34 of the feed port.

One feature of the example of FIG. 1 is that the cleaning ports 40 are secured relative to the nozzle 22 in fixed positions, which provides long-term, reliable operation of the cleaning ports 40 for directing the second fluid streams in the intended direction relative to the other components of the device 20. In this example, mounting members 52 secure some of the feed ports 30 in a fixed position relative to the nozzle 22. Other mounting members 54 secure others of the feed ports 30 in fixed positions relative to the nozzle 22. The mounting members 54 in this example also secure the cleaning ports 40 in fixed positions relative to the nozzle 22.

Figure 2:
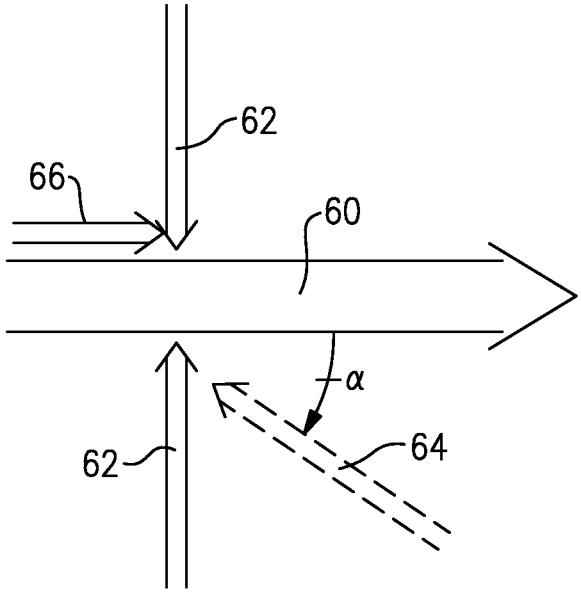
FIG. 2 schematically illustrates relative directions of flow used with the example of FIG. 1.

FIG. 2 schematically illustrates the relative orientations of the fluid streams in the illustrated example. The first fluid stream 60 is shown in a downstream direction (e.g., away from the nozzle 22). The arrows shown at 62 schematically represent the direction that the selected coating agent is introduced to the first fluid stream 60 from the feed ports 30. The second fluid stream from the cleaning ports 40 are schematically shown at 64. As can be appreciated from the illustration, the second fluid stream at 64 is in an upstream direction toward the nozzle 22.

The second fluid stream 64 is oriented at an oblique angle relative to the downstream direction of the first fluid stream 60 as shown at $\alpha$ in FIG. 2. The angle $\alpha$ in one example varies between a few degrees above zero and a few degrees below 90. In one example, the angle $\alpha$ is selected to be within a range between approximately 30° and 60°. In one example, the angle $\alpha$ is selected to be 45°. The angle $\alpha$ is selected to provide a glancing blow of the second fluid flow 64 across the face of the component intended to be cleaned by the second fluid flow (e.g., the face plate 26 or an end 34 of a feed port 30). The angle of orientation for the second fluid flow is intended to provide a cleaning function without disturbing the first fluid stream 60. An oblique angle is well-suited for that result.

Figure 3:
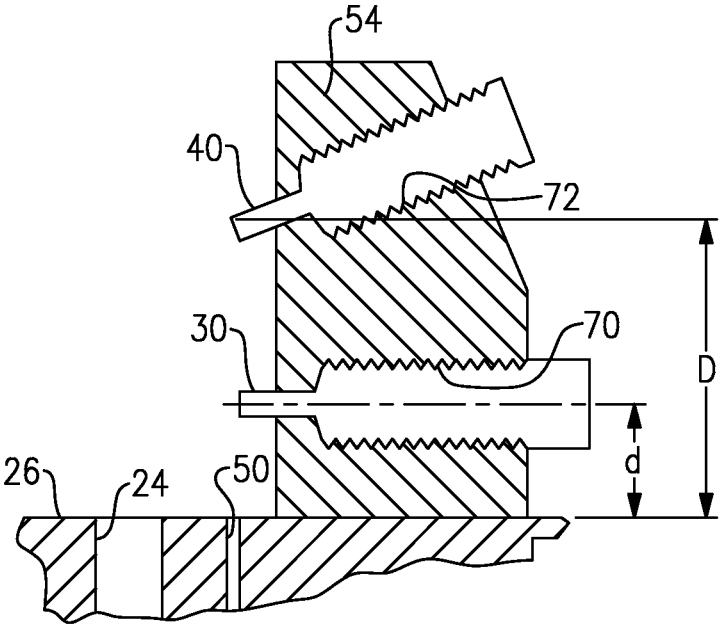
FIG. 3 is a partial, cross-sectional illustration of selected portions of the example of FIG. 1.

As can be appreciated from FIG. 3, the illustrated mounting members 54 comprise a block of metal material in this example. A first threaded bore 70 at least partially receives a threaded portion of a feed port 30 to secure the feed port 30 in a fixed position relative to the mounting member 54. When the mounting member 54 is fixed relative to the nozzle 22, the feed port 30 has a fixed position relative to the nozzle.

The example mounting member 54 also includes a threaded opening 72 that receives a correspondingly threaded portion of a cleaning port 40 for mounting the cleaning port 40 in a fixed position relative to the nozzle 22. The illustrated example includes the advantageous feature of having a single mounting member for securing feed ports and cleaning ports in fixed positions relative to a remainder of the device 20.

As can be appreciated from FIG. 3, the feed port 30 is spaced from the nozzle face plate 26 a first distance d in the downstream direction. The cleaning port 40 is spaced from the nozzle face 26 a second, greater distance D in the downstream direction.

The illustrated arrangement allows for precise and reliable positioning of the ports relative to each other and relative to the nozzle 22. In this example, the feed ports 30 and the cleaning ports 40 comprise identical components. This embodiment facilitates easier assembly and production economies requiring a smaller variety of components.

The illustrated example allows for consistently and precisely directing a fluid stream such as an air jet toward components that require cleaning and provides long term durability and allows for using relatively low-cost components. Additionally, the feed ports and cleaning ports of the illustrated example are replaceable and interchangeable.

The illustrated example provides improved repeatability of an automated cleaning process, which extends the time of use for the spray application device 20 between manual cleanings. All areas of the device 20 that may experience build up, which could interfere with a desired spray application result, can be reliably cleaned with the illustrated example arrangement and this provides efficiencies and improved economies for a variety of spray application processes.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A device for spray applications, comprising:

a nozzle configured to emit a first fluid stream in a downstream direction away from the nozzle, the nozzle including a face having a nozzle opening that establishes a location where the first fluid stream exits the nozzle;

at least one feed port situated near the nozzle for introducing an agent into the first fluid stream to be carried by the first fluid stream in the downstream direction, the at least one feed port including an end having a feed port opening that establishes a location where the agent exits the at least one feed port;

at least one cleaning port situated near the nozzle for emitting a second fluid stream in a generally upstream direction toward at least one of the nozzle or the at least one feed port, the second fluid stream following a primary trajectory directed at least partially across the nozzle face and not into the nozzle opening for cleaning an exterior of the nozzle face or following a primary trajectory directed at least partially across the end of the at least one feed port and not into the feed port opening for cleaning an exterior of the at least one feed port end;

a mounting member positioned at least partially downstream of the nozzle, the mounting member supporting the at least one feed port in a fixed position relative to the nozzle, the mounting member also supporting the at least one cleaning port in a fixed position relative to the nozzle and relative to the at least one feed port;

a plurality of feed ports and a plurality of cleaning ports circumferentially spaced about the nozzle, wherein there are twice as many feed ports as cleaning ports, and each of the second fluid streams is directed at a selected one of the feed ports; and a plurality of cleaning orifices adjacent the nozzle that each emit a third fluid stream in the downstream direction, wherein there are an equal number of cleaning ports and cleaning orifices, and wherein the third fluid streams are directed at other selected ones of the feed ports, respectively, such that each feed port is at least partially in a path of at least one of the second fluid streams or one of the third fluid streams.

2. The device of claim 1, wherein the at least one cleaning port is situated such that the second fluid stream is oriented at an oblique angle to the downstream direction of the first fluid stream.

3. The device of claim 2, wherein the second fluid stream is oriented at an angle between approximately 30 degrees and approximately 60 degrees.

4. The device of claim 3, wherein the second fluid stream is oriented at an angle of approximately 45 degrees.

5. The device of claim 1, wherein the second fluid stream is directed against a portion of the nozzle face adjacent the opening.

6. The device of claim 1, wherein the at least one feed port is spaced a first distance from the nozzle face in the downstream direction; and the at least one cleaning port is spaced a second, greater distance from the nozzle face in the downstream direction.

7. The device of claim 1, wherein the second fluid stream is generally perpendicular to a direction that the agent is emitted from the at least one feed port.

8. The device of claim 1, wherein the first fluid stream comprises a plasma stream, the agent comprises a powder and the second fluid stream comprises air.

9. A device for spray applications, comprising:

a nozzle configured to emit a first fluid stream in a downstream direction away from the nozzle;

a mounting member situated at least partially downstream of the nozzle;

at least one feed port held in a fixed position relative to the nozzle by the mounting member, the at least one feed port being configured for introducing an agent into the first fluid stream to be carried by the first fluid stream in the downstream direction; and at least one cleaning port supported by the mounting member in a fixed position relative to the nozzle and relative to the at least one feed port, the at least one feeding port being configured for emitting a second fluid stream in a generally upstream direction toward at least one of the nozzle or the at least one feed port;

wherein the mounting member comprises a block of metal material, the mounting member comprises a first threaded bore that at least partially receives a threaded portion of the at least one feed port to secure the feed port in a fixed position relative to the mounting member, and the mounting member comprises a second threaded bore that receives the correspondingly threaded portion of the at least one cleaning port for mounting the cleaning port in a fixed position relative to the nozzle.

10. The device of claim 9, comprising a plurality of the mounting members;

a corresponding plurality of feed ports; and a corresponding plurality of cleaning ports.

11. The device of claim 9, wherein the mounting member supports the at least one feed port a first distance from the nozzle in the downstream direction and supports the at least one cleaning port a second, greater distance from the nozzle in the downstream direction.

12. A device for spray applications, comprising:

a nozzle configured to emit a first fluid stream in a downstream direction away from the nozzle;

a mounting member situated at least partially downstream of the nozzle;

at least one feed port held in a fixed position relative to the nozzle by the mounting member, the at least one feed port being configured for introducing an agent into the first fluid stream to be carried by the first fluid stream in the downstream direction;

at least one cleaning port supported by the mounting member in a fixed position relative to the nozzle and relative to the at least one feed port, the at least one feeding port being configured for emitting a second fluid stream in a generally upstream direction toward at least one of the nozzle or the at least one feed port; and at least one other feed port not supported by the mounting member, the at least one other feed port being spaced further away from the at least one cleaning port than the at least one feed port.

13. A device for spray applications, comprising:

a nozzle configured to emit a first fluid stream in a downstream direction away from the nozzle;

a mounting member situated at least partially downstream of the nozzle;

at least one feed port held in a fixed position relative to the nozzle by the mounting member, the at least one feed port being configured for introducing an agent into the first fluid stream to be carried by the first fluid stream in the downstream direction;

at least one cleaning port supported by the mounting member in a fixed position relative to the nozzle and relative to the at least one feed port, the at least one feeding port being configured for emitting a second fluid stream in a generally upstream direction toward at least one of the nozzle or the at least one feed port;

a plurality of feed ports; and a plurality of mounting members;

wherein a number of mounting members in the plurality is less than a number of feed ports in the plurality of feed ports such that some of the feed ports are not supported by any of the mounting members.

14. The device of claim 13, comprising a plurality of cleaning ports;

wherein each of the cleaning ports is supported by a corresponding one of the mounting members.

* * * * *